US007274350B2

(12) United States Patent
Yeh

(10) Patent No.: US 7,274,350 B2
(45) Date of Patent: Sep. 25, 2007

(54) ANALOG BUFFER FOR LTPS AMLCD

(75) Inventor: Shin-Hung Yeh, Taipei (TW)

(73) Assignee: AU Optronics Corp., Hsinchu (TW)

( * ) Notice: Subject to any disclaimer, the term of this patent is extended or adjusted under 35 U.S.C. 154(b) by 722 days.

(21) Appl. No.: 10/761,211

(22) Filed: Jan. 22, 2004

(65) Prior Publication Data

US 2005/0162373 A1 Jul. 28, 2005

(51) Int. Cl.
*G09G 3/36* (2006.01)

(52) U.S. Cl. ..... 345/99; 345/100; 345/211

(58) Field of Classification Search ..... 345/87, 345/94, 99, 100, 98, 211–213
See application file for complete search history.

(56) References Cited

U.S. PATENT DOCUMENTS 5,266,936 A 11/1993 Saitoh
5,680,149 A 10/1997 Koyama et al.
5,959,475 A 9/1999 Zomorrodi
6,064,362 A * 5/2000 Brownlow et al. ..... 345/98
6,066,985 A 5/2000 Xu
6,075,524 A * 6/2000 Ruta ..... 345/210
6,127,997 A 10/2000 Tsuchi
6,215,348 B1 4/2001 Steensgaard-Madsen
6,232,948 B1 5/2001 Tsuchi
6,243,066 B1 6/2001 Murakami et al.
6,278,426 B1 * 8/2001 Akiyama ..... 345/87
6,459,332 B2 10/2002 Uchida
6,469,562 B1 * 10/2002 Shih et al. ..... 327/362
6,498,596 B1 12/2002 Nakamura et al.
6,525,719 B2 2/2003 Yamazaki et al.
6,538,632 B1 3/2003 Yamazaki et al.
6,563,270 B1 5/2003 Koyama
6,850,100 B2 * 2/2005 Takeshita ..... 327/112
7,138,967 B2 * 11/2006 Kimura ..... 345/76

FOREIGN PATENT DOCUMENTS

TW 472229 1/2002
TW 507187 10/2002

* cited by examiner

*Primary Examiner*—Kent Chang
(74) *Attorney, Agent, or Firm*—Thomas, Kayden, Horstemeyer & Risley

(57) ABSTRACT

A buffer circuit for a liquid crystal display device that comprises a first transistor further comprising a gate connectable to an input signal, a first electrode coupled to a first power supply, and a second electrode connectable to a second power supply, a second transistor further comprising a gate coupled to the second electrode of the first transistor, a first electrode connectable to the first power supply, and a second electrode connectable to the second power supply, a first capacitor being connectable to the input signal storing a voltage of the input signal when connected to the input signal, and providing a first voltage to the gate of the first transistor when disconnected from the input signal, a second capacitor further comprising a terminal coupled to the second electrode of the first transistor and the gate of the second transistor providing a second voltage at the terminal when the first transistor is turned on, and a third capacitor coupled to the first electrode of the second transistor providing a third voltage when the second transistor is turned on, wherein the second voltage further comprises a first offset including a gate to source voltage of the first transistor, and the third voltage further comprises a second offset including a gate to source voltage of the second transistor.

19 Claims, 7 Drawing Sheets

ANALOG BUFFER FOR LTPS AMLCD

DESCRIPTION OF THE INVENTION

1. Field of the Invention

This invention relates in general to a liquid crystal display ("LCD") device and, more particularly, to an analog buffer circuit for an LCD device and a method of compensating an offset voltage in a buffer circuit for an LCD device.

2. Background of the Invention

An active matrix liquid crystal display ("LCD") device generally includes a display panel and a drive circuit to drive the display panel. The drive circuit further includes gate drivers for selecting rows of gate lines and data drivers for providing pixel signals through data lines to pixels corresponding to selected gate lines. In a low temperature polycrystalline silicon ("LTPS") LCD, drive circuits may be formed directly on a glass substrate. A data driver of an LTPS LCD typically employs source-follower analog buffers at its output stage. A buffer using a source-follower amplifier outputs a voltage produced by subtracting the gate to source voltage of a transistor from an input voltage through the source-follower amplifier. However, there is a problem that the output voltage of the buffer is susceptible to the variation in the characteristics of a device. There is therefore an increasing demand for a compact buffer not susceptible to the characteristics of a device and having simple circuitry.

An example of the source-follower techniques in the art is disclosed in U.S. Pat. No. 6,469,562 (hereinafter the '562 patent) to Shih et al., entitled "Source Follower with VGS Compensation." The '562 patent discloses a source follower circuit including a constant current source. However, in an LTPS LCD, each data line may correspond to a buffer. For an increasing demand for higher resolution panels, the buffer circuit of the '562 patent may result in excessive power consumption. Furthermore, the constant current may be adversely affected by a drain to source voltage $V_{DS}$ of a transistor even though theoretically the constant current is proportional to $(V_{GS}-V_T)^2$ when the transistor functions in a saturation region, where $V_{GS}$ is a gate to source voltage, and $V_T$ is a threshold voltage of the transistor. As a result, the square term $(V_{GS}-V_T)$ is adversely affected, failing to properly provide linear compensation.

SUMMARY OF THE INVENTION

Accordingly, the present invention is directed to an analog buffer circuit and a method of compensating an offset voltage for an analog buffer that obviate one or more of the problems due to limitations and disadvantages of the related art.

To achieve these and other advantages, and in accordance with the purpose of the invention as embodied and broadly described, there is provided a buffer circuit for a liquid crystal display device that comprises a first transistor further comprising a gate connectable to an input signal, a first electrode coupled to a first power supply, and a second electrode connectable to a second power supply, a second transistor further comprising a gate coupled to the second electrode of the first transistor, a first electrode connectable to the first power supply, and a second electrode connectable to the second power supply, a first capacitor being connectable to the input signal storing a voltage of the input signal when connected to the input signal, and providing a first voltage to the gate of the first transistor when disconnected from the input signal, a second capacitor further comprising a terminal coupled to the second electrode of the first transistor and the gate of the second transistor providing a second voltage at the terminal when the first transistor is turned on, and a third capacitor coupled to the first electrode of the second transistor providing a third voltage when the second transistor is turned on, wherein the second voltage further comprises a first offset including a gate to source voltage of the first transistor, and the third voltage further comprises a second offset including a gate to source voltage of the second transistor.

Also in accordance with the present invention, there is provided a buffer circuit for a liquid crystal display device that comprises a first transistor further comprising a gate connectable to an input signal, a second transistor further comprising a gate coupled to an electrode of the first transistor, a first capacitor being connectable to the input signal and the gate of the first transistor storing a voltage of the input signal when connected to the input signal, and providing the voltage of the input signal to the gate of the first transistor when disconnected from the input signal, a second capacitor coupled to the gate of the second transistor providing a voltage to the gate of the second transistor including a first offset component when the first transistor is turned on, and a third capacitor providing a voltage including a second offset component to neutralize the first offset component when the second transistor is turned on.

Still in accordance with the present invention, there is provided a buffer circuit for a liquid crystal display device that comprises a first capacitor being connectable to an input signal storing a reference voltage during a first period, and storing a voltage of the input signal during a second period after the first period, a second capacitor providing a voltage including a first offset during the first period, and providing a voltage including another first offset to neutralize the first offset during the second period, a third capacitor providing a voltage including a second offset during the first period, and providing a voltage including another second offset to neutralize the second offset during the second period, and a fourth capacitor storing the first and second offsets during the first period.

Further in accordance with the present invention, there is provided a method of compensating an offset voltage in a buffer circuit for a liquid crystal display device that comprises providing an input signal, charging a first capacitor with a voltage of the input signal, providing the voltage of the input signal to a first transistor, turning on the first transistor, storing a voltage including a first offset voltage in a second capacitor, the first offset voltage further comprising a gate to source voltage of the first transistor, turning on a second transistor, and storing a voltage including a second offset voltage in a third capacitor, the second offset further comprising a gate to source voltage of the second transistor.

Yet still in accordance with the present invention, there is provided a method of compensating an offset voltage in a buffer circuit for a liquid crystal display device that comprises providing a reference signal, determining a first offset for a first transistor, storing the first offset, determining a second offset for a second transistor, storing the second offset, providing an input signal different from the reference signal, determining another first offset for the first transistor, storing the other first offset, determining another second offset for the second transistor, storing the other second offset, and neutralizing the first and second offsets with the other first offset and the other second offset.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1A:
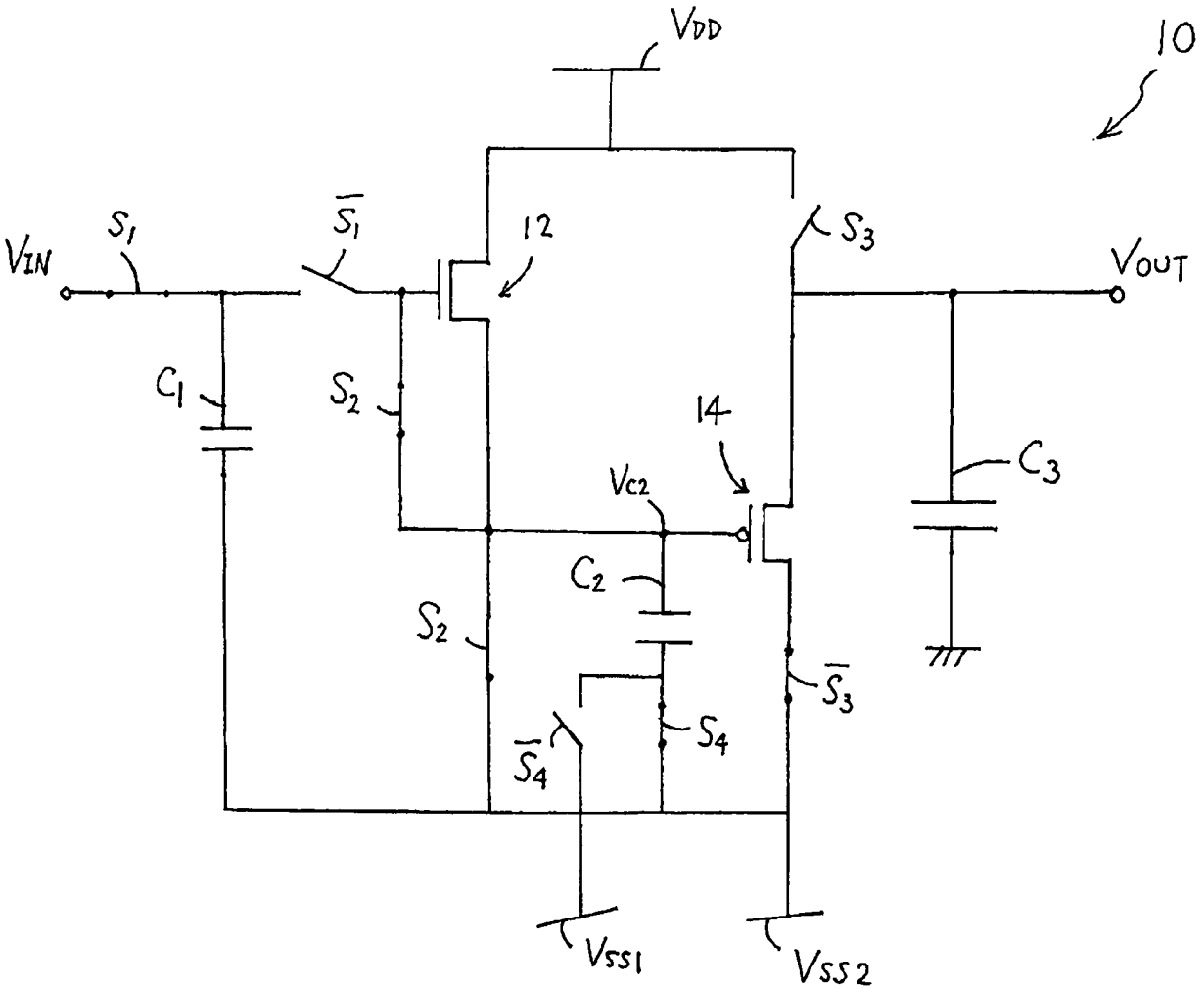
FIGS. 1A, 1B and 1C are circuit diagrams of an analog buffer in accordance with one embodiment of the present invention.
Figure 1B:
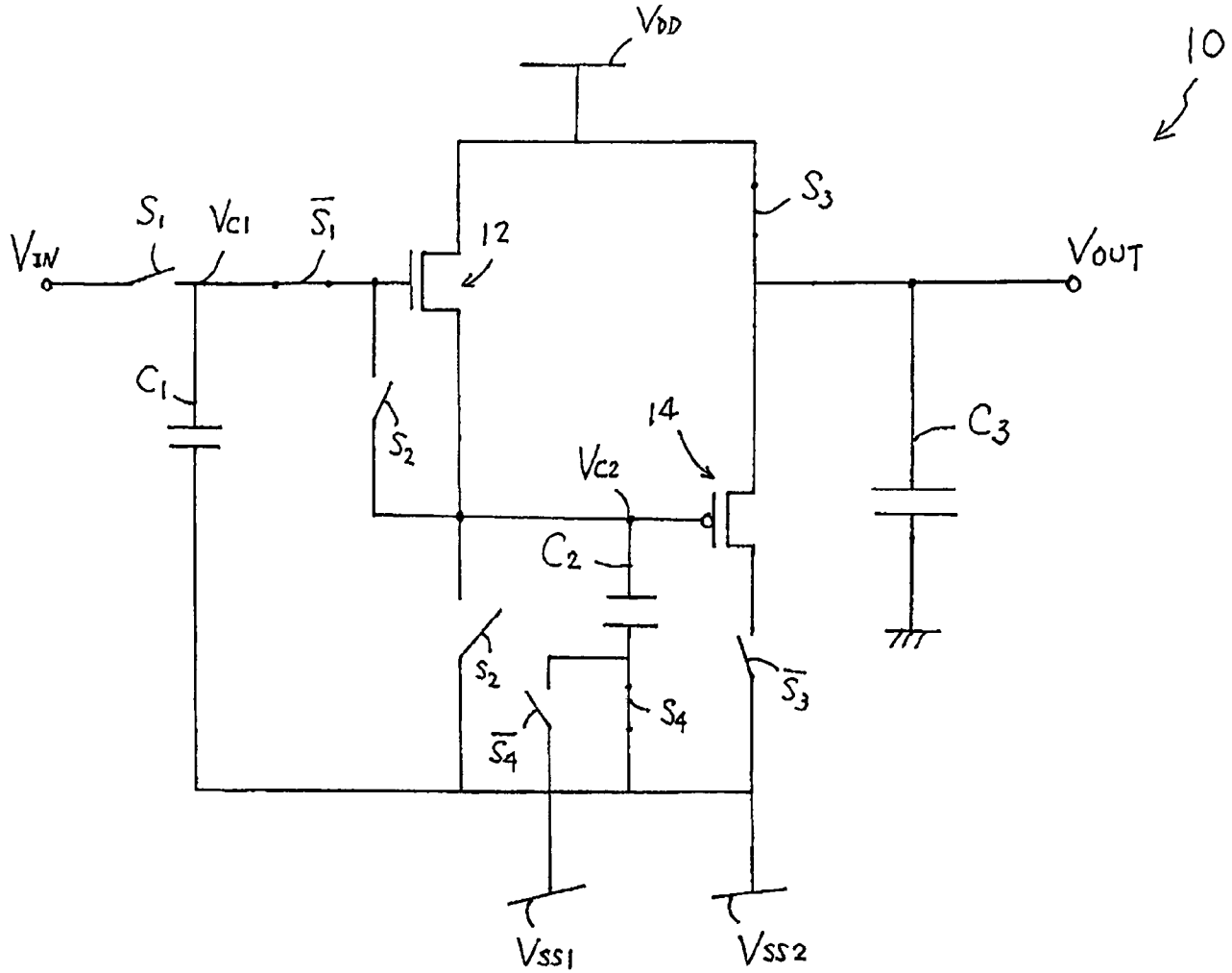
Figure 1C:
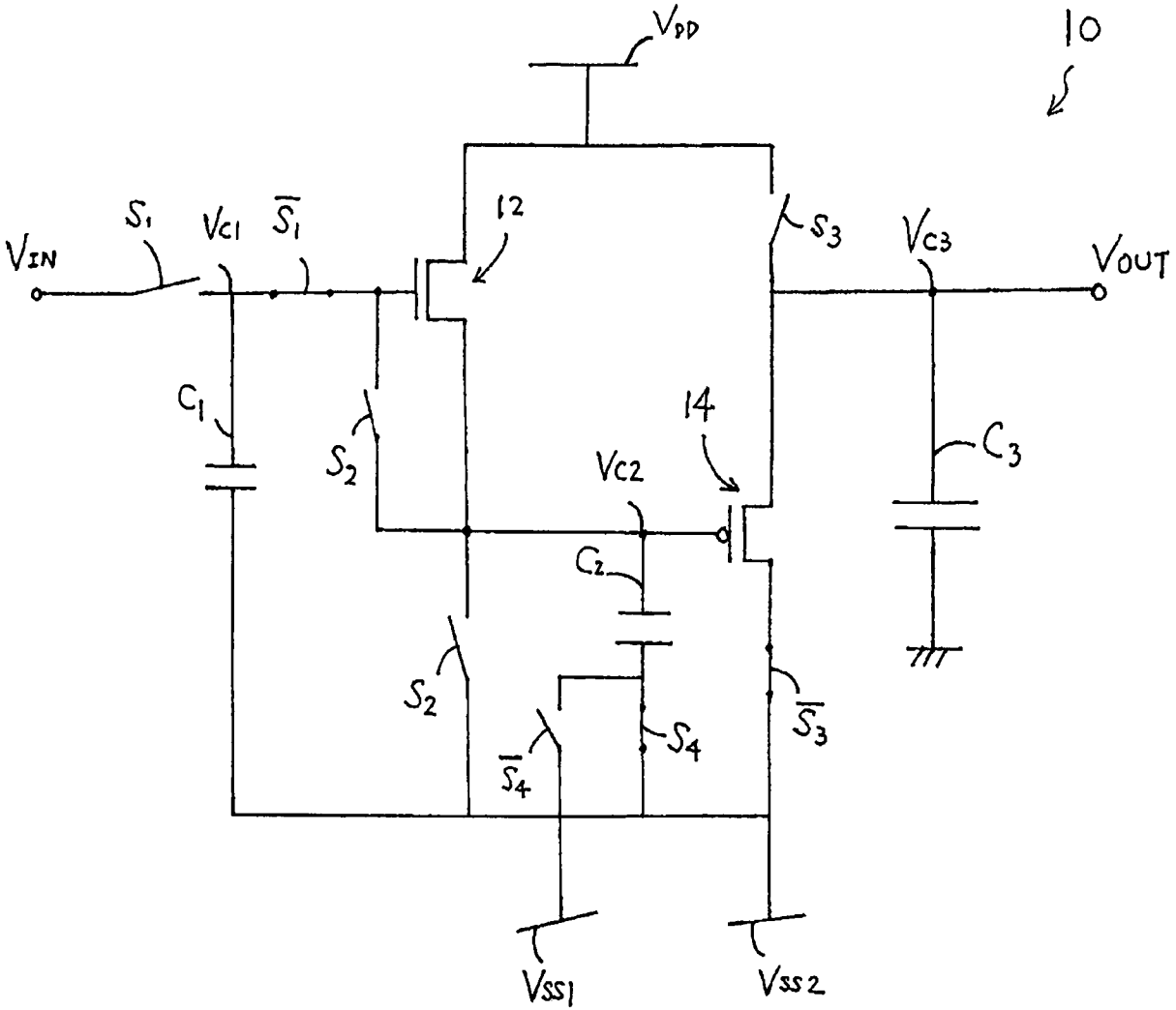

FIGS. 1A, 1B and 1C are circuit diagrams of an analog buffer 10 in accordance with one embodiment of the present invention. Analog buffer 10 functions to serve as a source follower wherein an output voltage $V_{OUT}$ follows an input voltage $V_{IN}$. Analog buffer 10 includes a first transistor 12, a second transistor 14, a first capacitor $C_1$, a second capacitor $C_2$, and a third capacitor $C_3$. Analog buffer 10 further includes a plurality of switches $S_1$, $\overline{S_1}$, $S_2$, $S_3$, $\overline{S_3}$, $S_4$ and $\overline{S_4}$, in which $S_1$ and $\overline{S_1}$, $S_3$ and $\overline{S_3}$, and $S_4$ and $\overline{S_4}$ are switch pairs. A switch pair refers to a pair of switches operating in opposite switch conditions. For example, when switch $S_1$ is closed, $\overline{S_1}$ is open, and vice versa.

First transistor 12 includes a gate (not numbered), a source (not numbered), and a drain (not numbered). The gate of first transistor 12 is coupled to input voltage $V_{IN}$ through switch pair $S_1$ and $\overline{S_1}$, to first capacitor $C_1$ through switch $\overline{S_1}$, and to second capacitor $C_2$ and second transistor 14 through switch $S_2$. The drain of first transistor 12 is coupled to a power supply line $V_{DD}$. The source of first transistor 12 is coupled to second capacitor $C_2$ and a gate of second transistor 14, and also coupled to a power supply line $V_{SS2}$ through another switch $S_2$. Second transistor 14 includes a gate (not numbered), a source (not numbered), and a drain (not numbered). The gate of second transistor 14 is coupled to the source of first transistor 12 and second capacitor $C_2$. The drain of second transistor 14 is coupled to $V_{SS2}$ through switch $\overline{S_3}$. The source of second transistor 14 is coupled to $V_{DD}$ through switch $S_3$, and to third capacitor $C_3$. Second capacitor $C_2$ includes one end (not numbered) coupled to the source of first transistor 12 and the gate of second transistor 14, and the other end (not numbered) coupled to $V_{SS2}$ through switch $S_4$, and to a power supply line $V_{SS1}$ through switch $\overline{S_4}$.

In one embodiment according to the invention, $V_{DD}$ is approximately 9 V (volts), $V_{SS2}$ is approximately −6 V, $V_{SS1}$ is greater than $V_{SS2}$ or approximately 0 V, and $V_{IN}$ ranges approximately from 0 to 4 V.

Analog buffer 10 operates in three stages in sequence to provide output voltage $V_{OUT}$. These stages are reset and sample, charge, and discharge and hold, which are illustrated in FIGS. 1A, 1B and 1C, respectively.

Referring to FIG. 1A, analog buffer 10 operates in the reset and sample stage. During this stage, switches $S_1$, $S_2$, $\overline{S_3}$ and $S_4$ are closed, and switches $\overline{S_1}$, $S_3$ and $\overline{S_4}$ are open. Input voltage $V_{IN}$ is stored in first capacitor $C_1$ and isolated from the gate terminal of first transistor 12 because switch $S_1$ is closed and switch $\overline{S_1}$ is open. A voltage $V_{C1}$ at one end (not numbered) of first transistor $C_1$ is approximately $V_{IN}$. Since the gate terminal of first transistor 12 is biased at $V_{SS2}$, first transistor 12 is turned off. Second transistor $C_2$ is discharged to a power supply line $V_{SS2}$ because switch $S_2$ is closed. A voltage $V_{C2}$ at one end (not numbered) of second capacitor $C_2$ is pulled to $V_{SS2}$. As a result, input voltage $V_{IN}$ is sampled and second capacitor $C_2$ is reset in the reset and sample stage.

Referring to FIG. 1B, analog buffer 10 operates in the charge stage. During this stage, switches $\overline{S_1}$, $S_3$ and $S_4$ are closed, and switches $S_1$, $S_2$, $\overline{S_3}$ and $\overline{S_4}$ are open. First transistor 12 is turned on by the voltage $V_{C1}$ provided by first capacitor $C_1$ and may operate in a saturation region. A voltage at the source of first transistor 12, that is, $V_{C2}$, is pulled to $V_{C1}-V_{GS1}$, where $V_{GS1}$ is the gate to source voltage of first transistor 12. As a result, second capacitor $C_2$ is charged to $V_{C1}-V_{GS1}$. On the other hand, since switch $S_3$ is closed, third capacitor $C_3$ is charged to $V_{DD}$.

Referring to FIG. 1C, analog buffer 10 operates in the discharge and hold stage. During this stage, switches $\overline{S_1}$, $\overline{S_3}$ and $S_4$ are closed, and switches $S_1$, $S_2$, $S_3$ and $\overline{S_4}$ are open. Since switch $\overline{S_3}$ is open and switch $S_3$ is clos transistor 14 is turned on and may operate in a saturation region. Third capacitor $C_3$ is discharged through second transistor 14. The voltage $V_{C3}$ at the source of second transistor 14 is discharged to approximately $V_{C2}+V_{SG2}$, that is, $V_{C1}-V_{GS1}+V_{SG2}$ or $V_{IN}-V_{GS1}+V_{SG2}$, where $V_{SG2}$ is the source to gate voltage of second transistor 14. As a result, output voltage $V_{OUT}$ is held at the voltage level $V_{IN}-V_{GS1}+V_{SG2}$.

After the discharge and hold stage, switch $\overline{S_4}$ is closed and switch $S_4$ is open to turn off first transistor 12 and second transistor 14, resulting in a decrease of leakage current. The voltages $V_{GS1}$ and $V_{SG2}$ are substantially equal to the threshold voltages $V_{th1}$ and $V_{th2}$ of first transistor 12 and second transistor 14, respectively, when transistors 12 and 14 are turned off from a saturation region. The output voltage $V_{OUT}$ becomes approximately $V_{IN}-V_{th1}+|V_{th2}|$, advantageously resulting in a linear compensation of input voltage $V_{IN}$.

FIGS. 2A, 2B, 2C and 2D are circuit diagrams of an analog buffer 30 in accordance with another embodiment of the present invention. Analog buffer 30 includes a first transistor 32, a second transistor 34, a first capacitor $CP_1$, a second capacitor $CP_2$, a third capacitor $CP_3$, and a fourth capacitor $CP_4$. Analog buffer 30 further includes a plurality of switches $SW_1$, $SW_2$, $SW_3$, $\overline{SW_3}$, $SW_4$, $\overline{SW_4}$, $SW_5$, $\overline{SW_5}$, $SW_6$ and $SW_7$, in which $SW_3$ and $\overline{SW_3}$, $SW_4$ and $\overline{SW_4}$, and $SW_5$ and $\overline{SW_5}$ are switch pairs.

First transistor 32 includes a gate (not numbered), a source (not numbered), and a drain (not numbered). The gate of first transistor 32 is coupled to input voltage $V_{IN}$ through switch $SW_1$, to a ground level through switch $SW_7$, and to one end (not numbered) of first capacitor $CP_1$. The other end (not numbered) of first capacitor $CP_1$ is coupled to one end (not numbered) of fourth capacitor $CP_4$ through switch $SW_5$, and to a ground level through switch $SW_6$. The drain of first transistor 32 is coupled to a power supply line $V_{DD}$. The source of first transistor 32 is coupled to second capacitor $CP_2$ and a gate of second transistor 34, and also coupled to a power supply line $V_{SS2}$ through switch $SW_2$.

Second transistor 34 includes a gate (not numbered), a source (not numbered), and a drain (not numbered). The gate of second transistor 34 is coupled to the source of first transistor 32 and second capacitor $CP_2$. The drain of second transistor 34 is coupled to $V_{SS2}$ through switch $\overline{SW_3}$. The source of second transistor 34 is coupled to $V_{DD}$ through switch $SW_3$, to third capacitor $CP_3$, and to fourth capacitor $CP_4$ through switch $SW_7$.

Second capacitor $CP_2$ includes one end (not numbered) coupled to the source of first transistor 32, the gate of second transistor 34, and to a power supply line $V_{SS1}$ through switch $\overline{SW_4}$. The other end (not numbered) of second capacitor $CP_2$ is coupled to $V_{SS2}$ through switch $SW_4$. Fourth capacitor $CP_4$ includes one end (not numbered) coupled to the source of second transistor 34 through $SW_7$, and to a ground level through $SW_5$. The other end (not numbered) of second capacitor $CP_4$ is coupled to first capacitor $CP_1$ through another switch $SW_5$, and to the ground level through $\overline{SW_5}$.

Analog buffer 30 operates in four stages in sequence to provide output voltage $V_{OUT}$. These stages are first reset and sample, first discharge and hold, second reset and sample, and second discharge and hold, which are illustrated in FIGS. 2A, 2B, 2C and 2D, respectively.

Figure 2A:
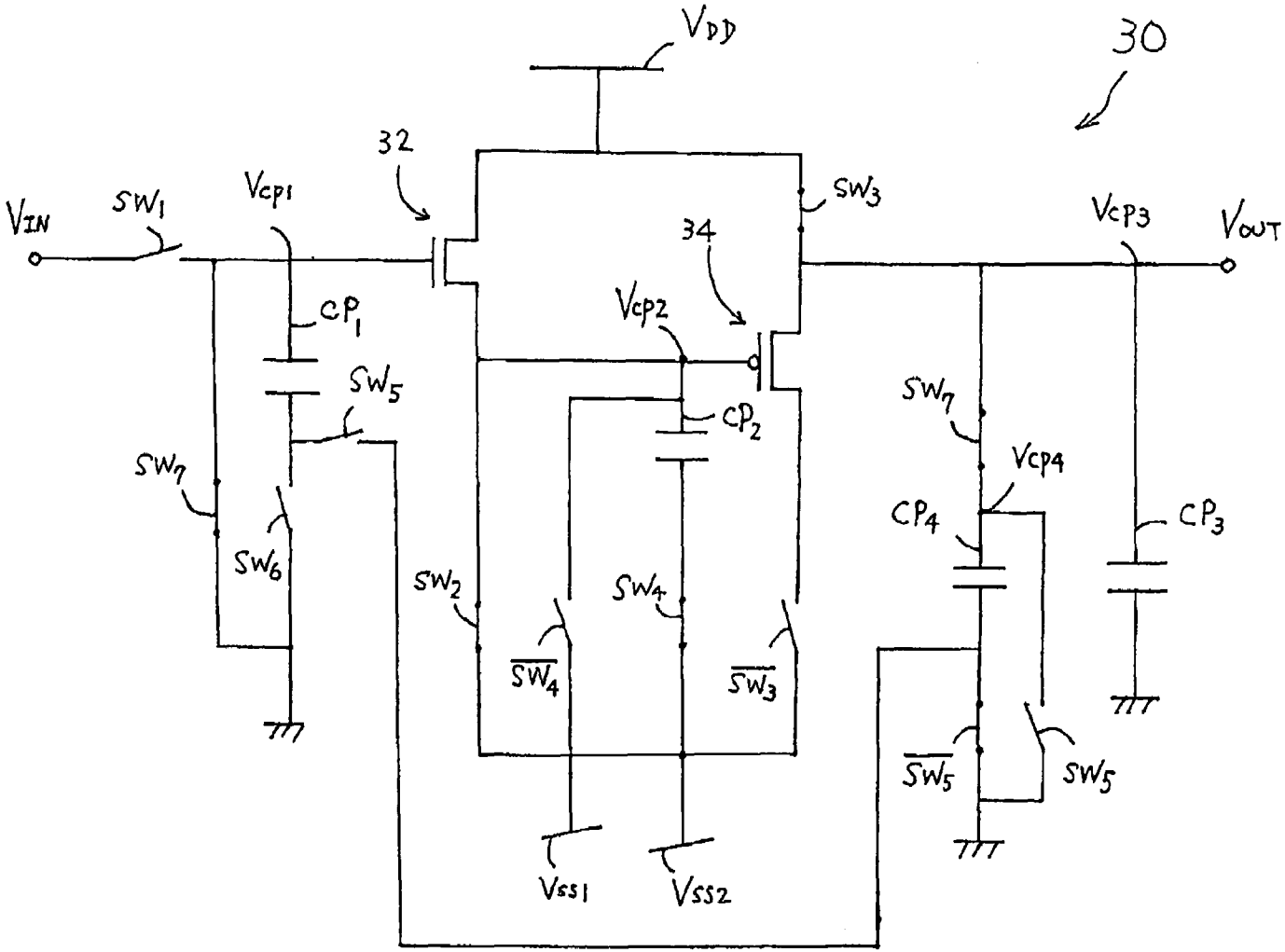
FIGS. 2A, 2B, 2C and 2D are circuit diagrams of an analog buffer in accordance with another embodiment of the present invention.

Referring to FIG. 2A, analog buffer 30 operates in the first reset and sample stage. During this stage, switches $SW_2$, $SW_3$, $SW_4$, $\overline{SW_5}$ and $SW_7$ are closed, and switches $SW_1$, $\overline{SW_3}$, $\overline{SW_4}$, $SW_5$ and $SW_6$ are open. Input voltage $V_{IN}$ is isolated from first transistor 32 because switch $SW_1$ is open. Since switch $SW_7$ is closed, a voltage $V_{CP1}$ at the one end of first capacitor $CP_1$ is zero. Since switches $SW_2$ and $SW_4$ are closed, a voltage $V_{CP2}$ at the one end of second capacitor $CP_2$ is pulled to $V_{SS2}$. First transistor 32 is turned on and may operate in a saturation mode. As a result, a zero voltage is sampled and second capacitor $CP_2$ is reset. After switches $SW_7$, $SW_2$ and $SW_4$ are closed, switches $SW_3$ and $\overline{SW_5}$ are closed to charge third capacitor $CP_3$ and fourth capacitor $CP_4$. A voltage $V_{CP3}$ at the one end of third capacitor $CP_3$ and a voltage $V_{CP4}$ at the one end of fourth capacitor $CP_4$ are charged to $V_{DD}$.

Figure 2B:
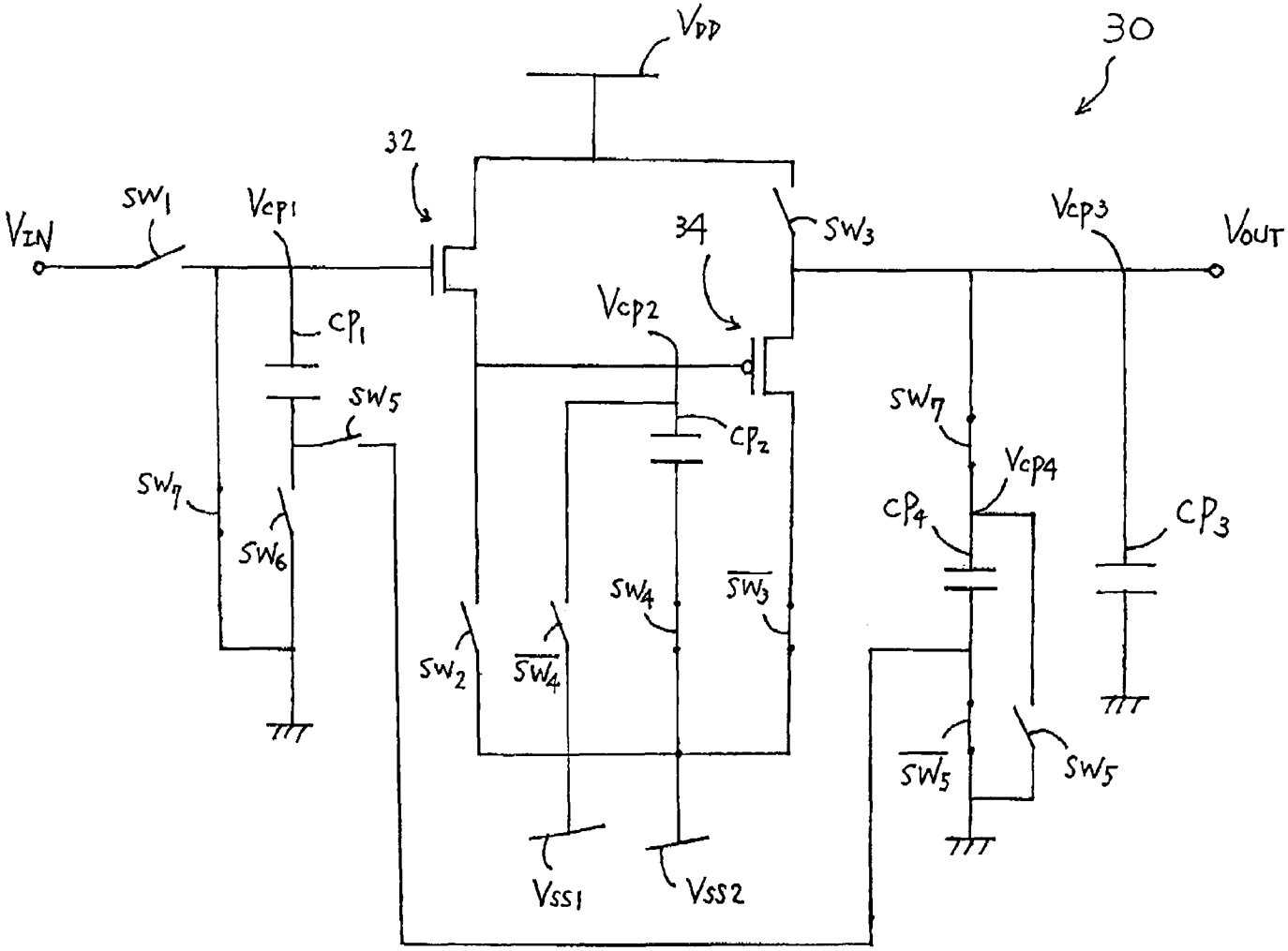

Referring to FIG. 2B, analog buffer 30 operates in the first discharge and hold stage. During this stage, switches $SW_4$, $\overline{SW_3}$, $\overline{SW_5}$ and $SW_7$ are closed, and switches $SW_1$, $SW_2$, $SW_3$, $\overline{SW_4}$, $SW_5$ and $SW_6$ are open. Since switch $SW_2$ is open, a voltage at the source of first transistor 32, that is, $V_{CP2}$, is pulled to $0-V_{GS1}$ or $-V_{GS1}$, where $V_{GS1}$ is the gate to source voltage of first transistor 12. Since switch $SW_3$ is open and switch $\overline{SW_3}$ is closed, second transistor 34 is turned on and may operate in a saturation region. Third capacitor $CP_3$ and fourth capacitor $CP_4$ are discharged through second transistor 34. The voltages $V_{CP3}$ and $V_{CP4}$ are discharged to $-V_{GS1}+V_{SG2}$, where $V_{SG2}$ is the source to gate voltage of second transistor 34 at the time $t_0$. As a result, an offset voltage $-V_{GS1}+V_{SG2}$ in response to an input level of zero is held in capacitor $CP_3$. The offset voltage determined at the first and second stages will be used later to compensate for input signal $V_{IN}$.

Figure 2C:
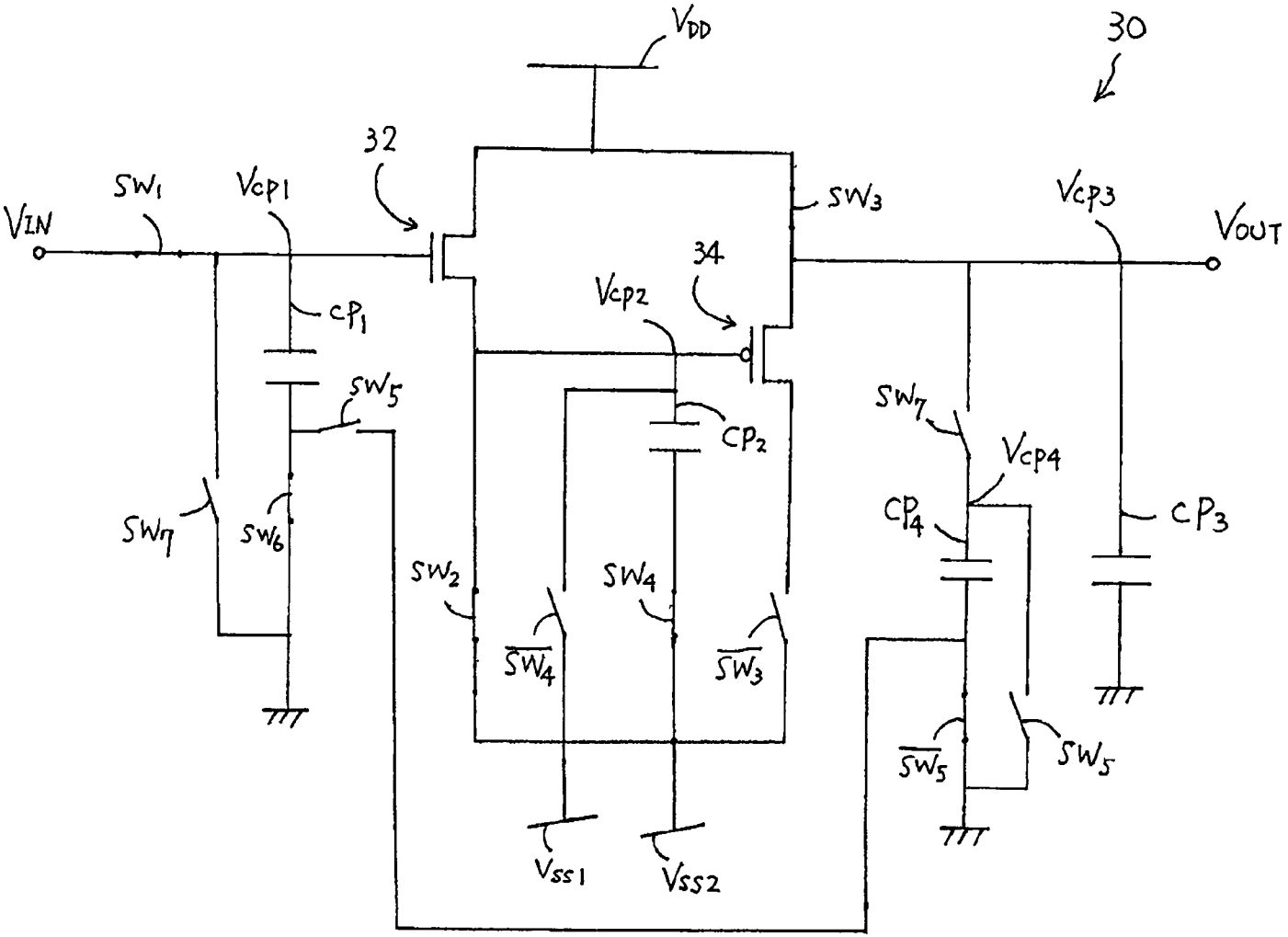

Referring to FIG. 2C, analog buffer 30 operates in the second reset and sample stage. During this stage, switches $SW_1$, $SW_2$, $SW_3$, $SW_4$, $\overline{SW_5}$ and $SW_6$ are closed, and switches $\overline{SW_3}$, $\overline{SW_4}$, $SW_5$ and $SW_7$ are open. Since switches $SW_1$ and $SW_6$ are closed and switch $SW_7$ are closed, $V_{CP1}$ is charged to $V_{IN}$. Since switches $SW_2$ and $SW_4$ are closed, $V_{CP2}$ is pulled to $V_{SS2}$. As a result, input voltage $V_{IN}$ is sampled and $V_{CP2}$ is again reset. $V_{CP3}$ is charged to $V_{DD}$ because switch $SW_3$ is closed. The offset voltage, $-V_{GS1}+V_{SG2}$, is kept in fourth capacitor $CP_4$ because switches $SW_5$ and $SW_7$ are open and switch $\overline{SW_5}$ is closed.

Figure 2D:
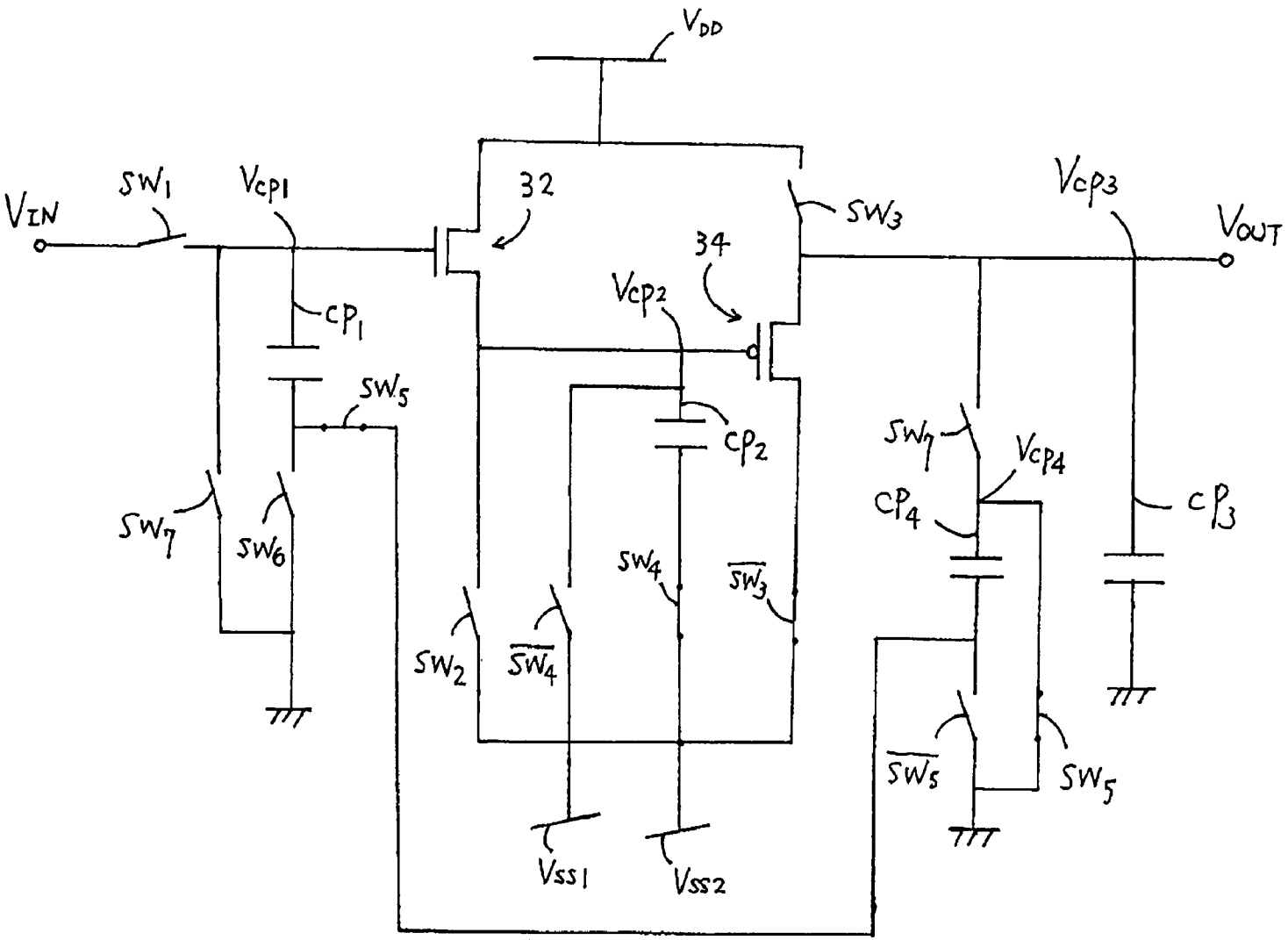

Referring to FIG. 2D, analog buffer 30 operates in the second discharge and hold stage. During this stage, switches $SW_4$, $\overline{SW_3}$, $SW_5$ are closed, and switches $SW_1$, $SW_2$, $SW_3$, $\overline{SW_4}$, $\overline{SW_5}$, $SW_6$ and $SW_7$ are open. Since switch $SW_5$ is closed, first capacitor $CP_1$ and fourth capacitor $CP_4$ are connected back to back. The voltage $V_{CP1}$ is pulled to $V_{IN}-(-V_{GS1}+V_{SG2})$. Since switch $SW_2$ is open, $V_{CP2}$ is pulled to $V_{IN}-(-V_{GS1}+V_{SG2})-V_{GS1}$. When second transistor 34 is later turned on, $V_{CP3}$ is discharged to $V_{IN}-(-V_{GS1}+V_{SG2})-V_{GS1}+V_{SG2}$, or $V_{IN}$, which is then held at third capacitor $CP_3$. As a result, the input signal $V_{IN}$ is compensated at the third and fourth stages by the offset voltage, that is, $-V_{GS1}+V_{SG2}$, obtained at the first and second stages.

The present invention also provides a method of compensating an offset voltage in a buffer circuit for a liquid crystal display device. An input signal $V_{IN}$ is provided. A first capacitor $C_1$ is charged with a voltage of the input signal $V_{IN}$. The voltage of the input signal $V_{IN}$ is provided to a first transistor 12. The first transistor 12 is turned on. A voltage $V_{C1}$ including a first offset voltage $V_{GS1}$ is stored in a second capacitor $V_{C2}$. The first offset voltage $V_{GS1}$ further comprises a gate to source voltage of first transistor 12. A second transistor 14 is turned on. A voltage $V_{C3}$ including a second offset voltage $V_{SG2}$ is stored in a third capacitor $C_3$. The second offset $V_{SG2}$ further comprises a gate to source voltage of second transistor 14.

In one embodiment, the first offset voltage further comprises a threshold voltage $V_{th1}$ of first transistor 12, and the second offset voltage further comprises a threshold voltage $V_{th2}$ of second transistor 14.

The present invention also provides another method of compensating an offset voltage in a buffer circuit for a liquid crystal display device. A reference signal is provided. A first offset $V_{GS1}$ related to a first transistor 32 is determined. The first offset $V_{GS1}$ is stored. A second offset $V_{SG2}$ related to a second transistor 34 is determined. The second offset $V_{SG2}$ is stored. An input signal $V_{IN}$ different from the reference signal is provided. Another first offset $V_{GS1}$ related to first transistor 32 is determined. The other first offset $V_{GS1}$ is stored. Another second offset $V_{SG2}$ related to second transistor 34 is determined. The other second offset $V_{SG2}$ is stored. The first and second offsets are neutralized with the other first and second offsets.

In one embodiment according to the invention, the first offset is stored in a second capacitor $CP_2$, and the second offset is stored in a third capacitor $CP_3$. In another embodiment, the first and second offsets are stored in a fourth capacitor $CP_4$. In still another embodiment, the other first offset is stored in second capacitor $CP_2$, and the other second offset is stored in third capacitor $CP_3$. In another embodiment, the other first and other second offsets are stored in fourth capacitor $CP_4$.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A buffer circuit for a liquid crystal display device comprising: a first transistor further comprising a gate connectable to an input signal, a first electrode coupled to a first power supply, and a second electrode connectable to a second power supply; a second transistor further comprising a gate coupled to the second electrode of the first transistor, a first electrode connectable to the first power supply, and a second electrode connectable to the second power supply; a first capacitor being connectable to the input signal storing a voltage of the input signal when connected to the input signal, and providing a first voltage to the gate of the first transistor when disconnected from the input signal; a second capacitor further comprising a terminal coupled to the second electrode of the first transistor and the gate of the second transistor providing a second voltage at the terminal when the first transistor is turned on; and a third capacitor coupled to the first electrode of the second transistor providing a third voltage when the second transistor is turned on; wherein the second voltage further comprises a first offset including a gate to source voltage of the first transistor, and the third voltage further comprises a second offset including a gate to source voltage of the second transistor.

2. The circuit of claim 1 further comprising a fourth capacitor including one terminal connectable to the second electrode of the second transistor, and another terminal connectable to the first capacitor.

3. The circuit of claim 1, the first voltage further comprising the voltage of the input signal.

4. The circuit of claim 1, the first voltage further comprising a reference voltage.

5. The circuit of claim 1, the first voltage further comprising the voltage of the input signal and offset voltages including a gate to source voltage each of the first transistor and the second transistor.

6. The circuit of claim 1, the second voltage further comprising the first voltage and an offset voltage including a gate to source voltage of the first transistor.

7. The circuit of claim 1, the third voltage being compensated by a threshold voltage each of the first transistor and the second transistor.

8. The circuit of claim 2, the fourth capacitor providing a fourth voltage when second transistor is turned on.

9. The circuit of claim 8, the fourth voltage further comprising offset voltages including a gate to source voltage each of the first and second transistors.

10. A buffer circuit for a liquid crystal display device comprising: a first transistor further comprising a gate connectable to an input signal; a second transistor further comprising a gate coupled to an electrode of the first transistor; a first capacitor being connectable to the input signal and the gate of the first transistor storing a voltage of the input signal when connected to the input signal, and providing the voltage of the input signal to the gate of the first transistor when disconnected from the input signal; a second capacitor coupled to the gate of the second transistor providing a voltage to the gate of the second transistor including a first offset component when the first transistor is turned on; and a third capacitor providing a voltage including a second offset component to neutralize the first offset component when the second transistor is turned on.

11. The circuit of claim 10, the first offset component further comprising a gate to source voltage of the first transistor.

12. The circuit of claim 10, the first offset component further comprising a threshold voltage of the first transistor.

13. The circuit of claim 10, the second offset component further comprising a gate to source voltage of the second transistor.

14. The circuit of claim 10, the second offset component further comprising a threshold voltage of the second transistor.

15. A buffer circuit for a liquid crystal display device comprising: a first capacitor being connectable to an input signal storing a reference voltage during a first period, and storing a voltage of the input signal during a second period after the first period; a second capacitor providing a voltage including a first offset during the first period, and providing a voltage including another first offset to neutralize the first offset during the second period; a third capacitor providing a voltage including a second offset during the first period, and providing a voltage including another second offset to neutralize the second offset during the second period; and a fourth capacitor storing the first and second offsets during the first period.

16. The circuit of claim 15 further comprising a first transistor and a second transistor.

17. The circuit of claim 16, the first and second offsets further comprising a gate to source voltage of the first transistor and the second transistor, respectively.

18. The circuit of claim 16, the other first and another second offsets further comprising a gate to source voltage of the first and second transistors, respectively.

19. The circuit of claim 15, the reference voltage further comprising a zero voltage.

* * * * *